US005396320A

United States Patent [19]

Lange

[11] Patent Number: 5,396,320

[45] Date of Patent: Mar. 7, 1995

[54] APPARATUS AND METHOD FOR CLEANING A SUBSTRATE IN A PRINTING APPARATUS

[75] Inventor: Clark V. Lange, Ontario, N.Y.

[73] Assignee: Xerox Corporation, Stamford, Conn.

[21] Appl. No.: 173,000

[22] Filed: Dec. 27, 1993

[51] Int. Cl.[6] ..... G03G 15/20

[52] U.S. Cl. ..... 355/299; 355/211; 355/296

[58] Field of Search ..... 355/296, 297, 299, 215, 355/211, 212, 77; 15/1.51

[56] References Cited

U.S. PATENT DOCUMENTS 4,396,276 8/1983 Murasaki ..... 355/299
4,640,608 2/1987 Higaya et al. ..... 355/299
4,702,591 10/1987 Tsuda et al. ..... 355/299
5,073,800 12/1991 Yamaguchi et al. ..... 355/297
5,083,169 1/1992 Usui et al. ..... 355/296
5,111,251 5/1992 Uno et al. ..... 355/297

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

An electrostatic printer having a cleaning blade for removing residual particles from the surface of a photoconductive substrate. A mechanism automatically retracts the cleaning blade away from the substrate to avoid scrapping the cleaning blade against a seam on the substrate.

32 Claims, 5 Drawing Sheets

APPARATUS AND METHOD FOR CLEANING A SUBSTRATE IN A PRINTING APPARATUS

BACKGROUND OF THE INVENTION

1. Field of the Invention

The present invention relates generally to an apparatus and method for cleaning a substrate in a printing apparatus, and more particularly to an apparatus and method for cleaning a substrate without excessively affecting uniform motion of the substrate in a manner that would impair image quality.

2. Discussion of the Related Art

A typical document copier includes an electrostatic printer having a belt with a photoconductive surface. To transfer an image onto a sheet of paper, the printer charges the belt to a uniform potential, and then selectively exposes the belt to a pattern of light corresponding to the image. The light discharges parts of the belt resulting in a pattern of charge corresponding to the image, an electrostatic latent image, being formed on the belt. The portion of the belt having the electrostatic image then passes a development station that deposits toner on the belt in the pattern of the image, resulting in a developed image. A sheet of paper is then tacked onto the belt and removed from the belt, resulting in the image being formed on the paper.

A proposed electrostatic printer includes a cleaning station downstream from the development station. The cleaning station removes residual toner from the belt. The cleaning station includes a cleaning blade for scraping toner from the belt.

The surface of the belt of the proposed printer typically has a seam spanning the width of the belt. The cleaning blade passing over the seam results in a disturbance in uniform motion of the belt, which can impair image quality if the disturbance occurs while an image is being developed as described above. Further, the cleaning blade passing over the seam results in mechanical stress being placed on the blade, reducing the life of the blade.

Problems caused by these variations in belt motion are exacerbated in single pass full color printers, which require especially accurate placement on the belt of overlying multiple images corresponding to each color component.

OBJECTS AND SUMMARY OF THE INVENTION

It is an object of the invention to provide an apparatus and method for cleaning a substrate in a printing apparatus without excessively affecting uniform motion of the substrate in a manner that would impair image quality.

It is a further object of the present invention to provide an apparatus and method for cleaning a substrate that does not produce excessive wear on the printing apparatus.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus comprises a substrate having a substantially uniform surface portion, and a nonuniform surface portion; a particle remover for removing particles from the substrate; means for moving the substrate relative to the particle remover; and means for moving the particle remover away from the substrate when the nonuniform surface portion of the substrate passes the particle remover.

To achieve the objects and in accordance with the purpose of another aspect of the invention, as embodied and broadly described herein, a method of operating an apparatus including a substrate having a substantially uniform surface portion, and a nonuniform surface portion, and a particle remover for removing particles from the substrate, comprising the steps of moving the substrate relative to the particle remover; and moving the particle remover away from the substrate when the nonuniform surface portion of the substrate passes the particle remover.

To achieve the objects and in accordance with the purpose of another aspect of the invention, as embodied and broadly described herein, an apparatus comprises a moveable substrate; a cam on the substrate; and a particle remover for removing particles from the substrate, the particle remover being engageable with the cam to move away from the substrate.

To achieve the objects and in accordance with the purpose of another aspect of the invention, as embodied and broadly described herein, an assembly for a printing apparatus comprises a moveable substrate having a seam; cleaning means engageable with the substrate; and means for disengaging the cleaning means from the substrate when the seam passes between the substrate and the cleaning means.

To achieve the objects and in accordance with the purpose of another aspect of the invention, as embodied and broadly described herein, an apparatus comprises a substrate having a substantially uniform surface portion, and a nonuniform surface portion; a subassembly; a particle remover, coupled to the subassembly, for removing particles from the substrate; means for moving the substrate relative to the subassembly; and means for moving the subassembly away from the substrate when the nonuniform surface portion of the substrate passes the particle remover.

To achieve the objects and in accordance with the purpose of another aspect of the invention, as embodied and broadly described herein, a method of operating an apparatus including a substrate having a substantially uniform surface portion, and a nonuniform surface portion, a subassembly, and a particle remover, coupled to the subassembly, for removing particles from the substrate, comprises the steps of moving the substrate relative to the subassembly; and moving the subassembly away from the substrate when the nonuniform surface portion of the substrate passes the subassembly.

To achieve the objects and in accordance with the purpose of another aspect of the invention, as embodied and broadly described herein, an apparatus comprises a moveable substrate; a cam on the substrate; a subassembly engageable with the cam to move away from the substrate; and a particle remover, coupled to the subassembly, for removing particles from the substrate.

To achieve the objects and in accordance with the purpose of another aspect of the invention, as embodied and broadly described herein, an apparatus comprises a substrate having a substantially uniform surface portion, and a nonuniform surface portion; a particle remover for removing particles from the substrate, by applying a pressure to the substrate; means for moving the substrate relative to the particle remover; and means for causing the particle remover to reduce the pressure when the nonuniform surface portion of the substrate passes the particle remover.

To achieve the objects and in accordance with the purpose of another aspect of the invention, as embodied and broadly described herein, a method of operating an apparatus including a substrate having a substantially uniform surface portion, and a nonuniform surface portion, and a particle remover for removing particles from the substrate by applying a pressure to the substrate, comprises the steps of moving the substrate relative to the particle remover; and causing the particle remover to reduce the pressure when the nonuniform surface portion of the substrate passes the particle remover.

To achieve the objects and in accordance with the purpose of another aspect of the invention, as embodied and broadly described herein, an assembly for a printing apparatus comprises a moveable substrate having a seam; means for applying a pressure to the substrate; and means for causing the applying means to reduce the pressure when the seam passes between the substrate and the applying means.

BRIEF DESCRIPTION OF THE DRAWINGS

The accompanying drawings, which are incorporated in and which constitute a part of this specification, illustrate one embodiment of the invention and, together with the description, explain the principles of the invention. In the drawings.

DESCRIPTION OF THE PREFERRED EMBODIMENTS

Figure 1:
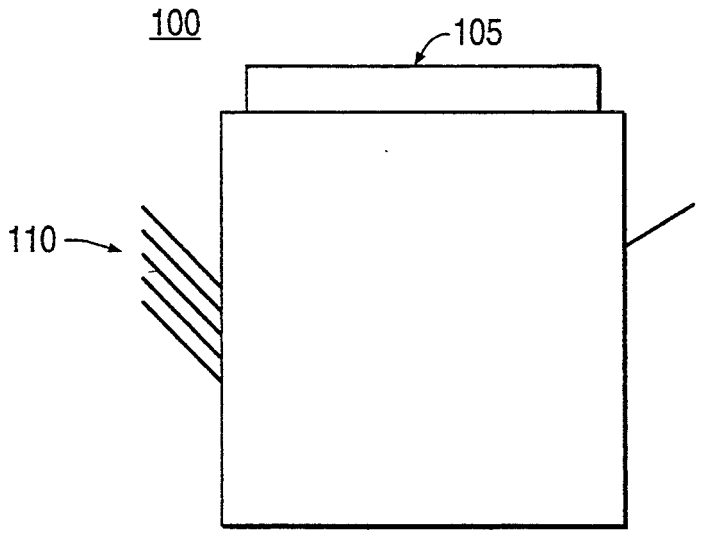
FIG. 1 is an external view of the copier of the preferred embodiments of the present invention.

As shown in FIG. 1, a copier 100 representing a preferred embodiment of the present invention includes a document feeder 105 for transporting an original document to a platen (not shown) where copier 100 scans the original document. Copier 100 then duplicates the image of the original document onto a sheet of paper and delivers the sheet of paper to paper output trays 110.

Figure 2:
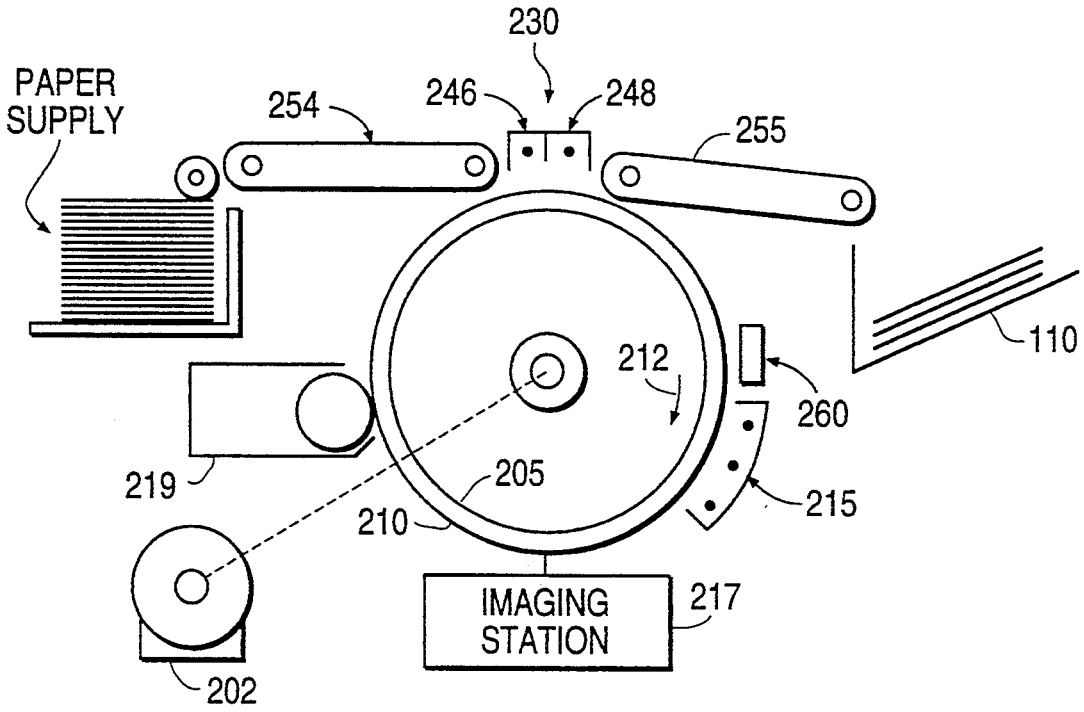
FIG. 2 is a schematic elevational view depicting various components of the copier shown in FIG. 1, according to the preferred embodiments of the present invention.

In FIG. 2, the interior of copier 100 shown in FIG. 1 is shown to include a drum 205 supporting a photoreceptor belt 210. Drum 205 has a cylindrical shape and is composed of metal. Alternatively, drum 205 may be composed of clear plastic, allowing for illumination of belt 210 from the interior of drum 205.

Motor 202 drives photoreceptor belt 210 in the direction of arrow 212 to advance successive portions of belt 210 sequentially through the various processing stations disposed about the path of movement of belt 210. Initially a portion of belt 210 passes through charging station 215. Charging station 215 includes a corona device that charges a portion of belt 210 to a relatively high, substantially uniform potential, either positive or negative.

At imaging station 217, light rays from the original document are reflected through a lens and projected onto the charged portion of belt 210 to selectively discharge the charge on belt 210. This selective discharging records an electrostatic latent image, corresponding to an image on the original document, on belt 210. Alternatively, a laser may be provided to selectively discharge belt 210 in accordance with stored electronic information.

Belt 210 then advances the electrostatic latent image to development station 219. Development station 219 includes a rotating magnetic member to advance developer mix, carrier beads and toner, into contact with the electrostatic latent image. The electrostatic latent image attracts toner particles from the carrier beads, thereby forming a toner powder image on belt 210.

Belt 210 then advances the toner powder image to transfer station 230, where a sheet of paper from conveyor 254 advances into contact with the toner powder image on belt 210. A corona generating device 246 charges the paper to a potential such that the paper becomes tacked to belt 210 and the toner powder image is attracted from the belt 210 to the paper. Subsequently, a corona generator 248 charges the paper causing the paper to be detached from belt 210 and transported by conveyor 255 to a fusing station (not shown).

The fusing station includes a heated fuser roller and a backup roller, for contacting the toner powder images with the fuser roller to permanently affix to the toner to the paper.

Cleaning station 260 removes residual toner particles remaining on belt 210.

Figure 4:
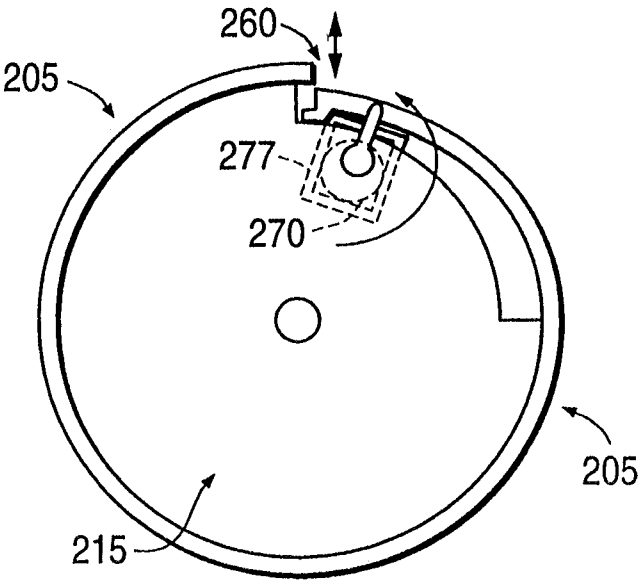
FIG. 4 is another enlarged end view of the drum component shown in FIG. 2 but in a different state.
Figure 3:
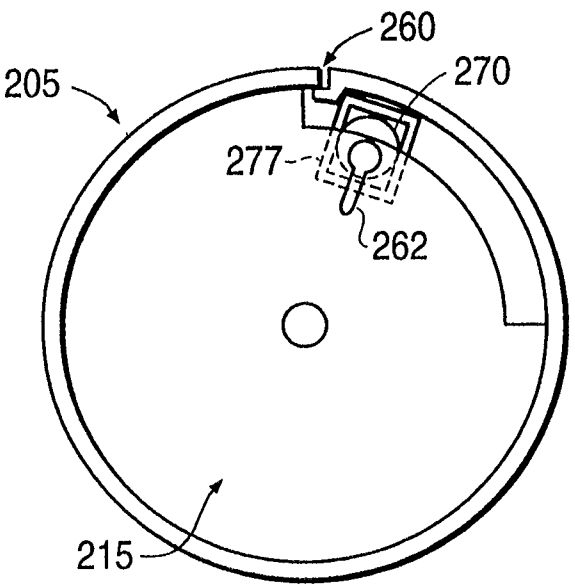
FIG. 3 is an enlarged end view of a drum component shown in FIG. 2.

As shown in FIGS. 3 and 4, drum 205 includes a slit 260 that spans the length of drum 205, an end plate 215, an actuator 277, a cam 270, and a lever 262. Drum 205 includes two end plates 215, one at each end of drum 205. FIG. 3 shows drum 205 in an uncompressed state and FIG. 4 Shows drum 205 in a compressed state.

Slit 260 allows drum 205 to be compressed when installing a new belt 210. As shown in FIGS. 3 and 4, the surface of drum 205 is supported by end plate 215 at only approximately $\frac{3}{4}$ of the diameter of drum 205. Drum 205 is compressed in the $\frac{1}{4}$ portion of drum 205 that is not supported by end plate 215.

Figure 5:
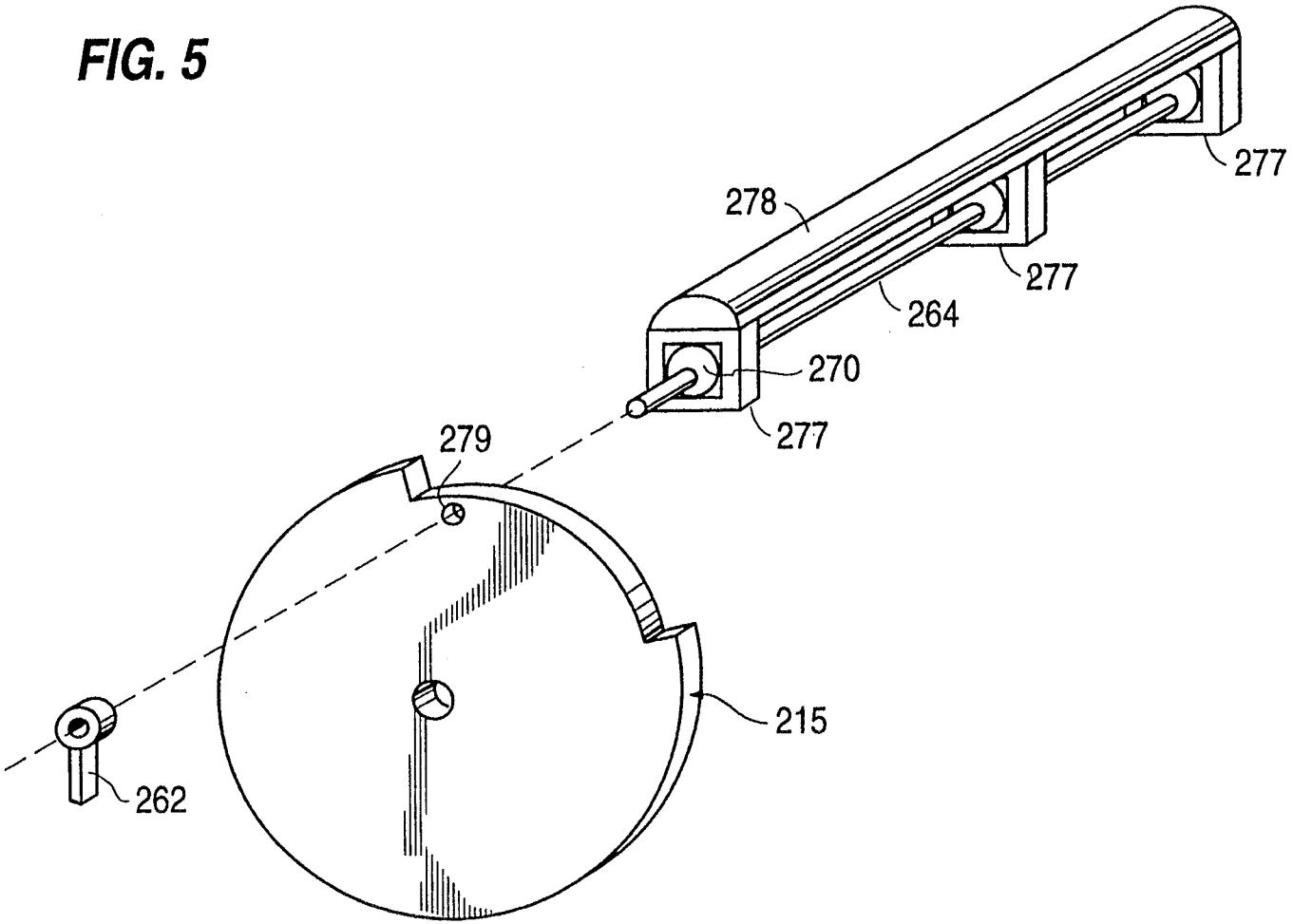
FIG. 5 is an exploded view showing some of the drum component of FIG. 4 in more detail.

As shown in FIG. 5, drum 205 also includes a rod 264 that is rotatably mounted in hole 279 in each of the end plates 215. Lever 262 is mounted on rod 264. Crossbar 278 is attached to the inner surface of drum 205 along the entire length of drum 205.

To install a new belt 210, a user rotates rod 264 by rotating lever 262 to reduce the diameter of drum 205, by compressing drum 205, until a latch (not shown) locks the mechanism in place. At this time, the user can slide off belt 210 and slide on a new belt. The user then releases the latch and drum 205 returns to its nominal diameter. Because the nominal diameter of belt 210 is slightly smaller than that of the drum 205, there is a tight fit between drum belt 210 and drum 205.

As shown in FIGS. 3, 4, and 5, rotation of rod 264 counterclockwise rotates cam 270, to exert a downward force on actuator 277. Actuator 277 then pulls down on drum 205 to decrease the diameter of drum 205. The latch then locks the mechanism in this position.

Figure 6:
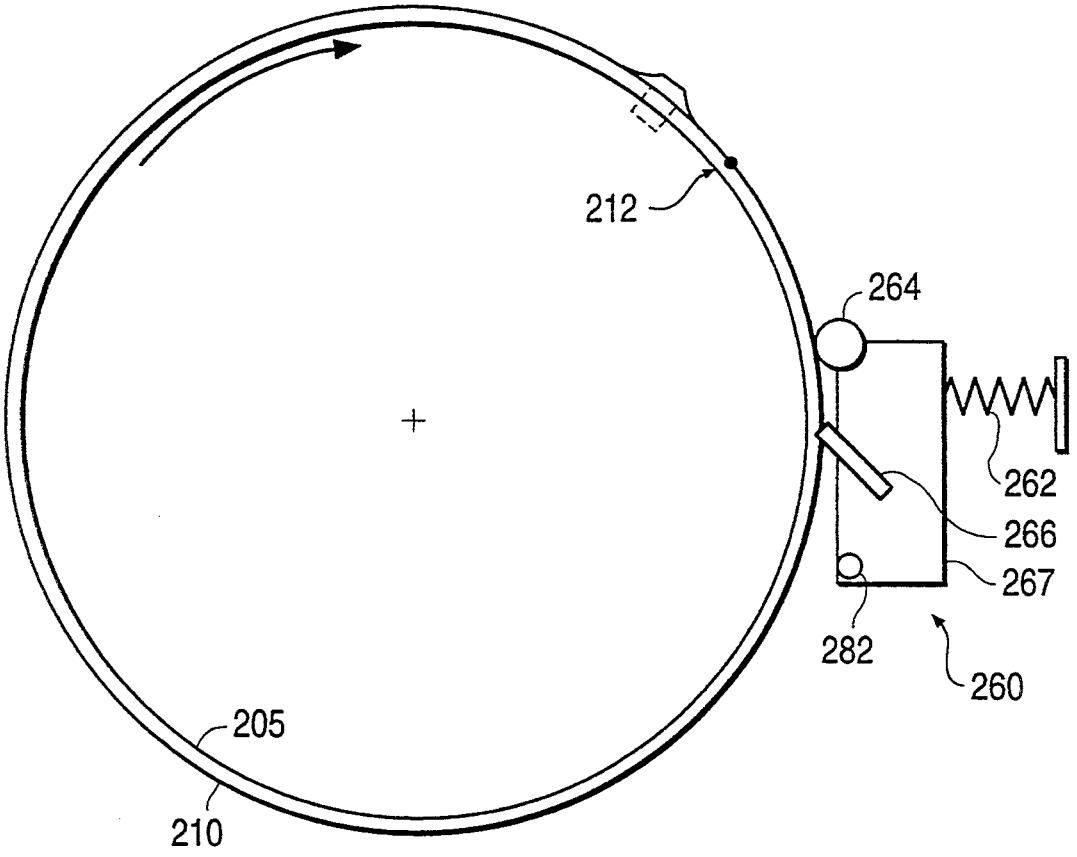
FIG. 6 is an enlarged end view of components shown in FIG. 2.

FIG. 6 shows cleaning station 260 in more detail. Cleaning station 260 includes a cleaning blade 266 composed of a rubber-like material such as polyurethane. Cleaning blade 266 scrapes toner from the surface of belt 210. Housing 267 holds blade 266. Housing 267 is pivotably mounted on hinge 282, which is fixed relative to drum 205. Spring 262 biases cleaning blade 266 against belt 210. Follower wheel 264 is rotatably mounted to housing 267. Follower wheel is normally removed from belt 210. Follower wheel 264 is sufficiently close to belt 210, however, to engage ramp 235 when ramp 235 passes between follower wheel 264 and belt 210.

Ramp 235 is preferably an injection molded plastic plug.

Seam 212 represents a discontinuity of the surface of belt 210, which can be caused by, for example, a welding seam of belt 210 itself. A discontinuity of the surface of belt 210 can also be caused by a discontinuity in drum 205 caused by, for example, slit 260.

Before seam 212 reaches cleaning blade 266, follower wheel 264 engages ramp 235 to lift housing 267 away from belt 210, thereby lifting blade 266 away from belt 210 to minimize interaction between blade 266 and seam 212, thereby avoiding motion quality disturbances that would adversely affect image quality. This disengagement of cleaning blade 266 from belt 210 also prevents seam 212 from damaging cleaning blade 266.

In other words, drum 205 and belt 210 function as a substrate, with seam 212 constituting a nonuniform surface portion of the substrate. Housing 267 is effectively a subassembly to which blade 266 is coupled. Motor 202 functions to move the substrate relative to the subassembly, and ramp 235 functions to move the subassembly away from the substrate when the nonuniform surface portion of the substrate passes blade 266.

If ramp 235 were not present, when blade 266 passed seam 212, blade 266 would be biased against seam 212 causing a sudden change in drag on drum 205, thereby affecting the speed of drum 205. Ramp 235 prevents blade 266 from being biased against seam 212, however, causing a relatively gradual change in drag on drum 205 as follower wheel 264 contacts ramp 235. The change in drag is gradual because, when follower wheel 264 initially contacts ramp 235, housing 267 moves away from belt 210 but blade 266 gradually reduces the pressure applied to belt 210 before moving away from belt 210. This gradual reduction in pressure before blade 266 moves away from belt 210 results from the fact that blade 266 has a spring quality and is not rigid. The change in drag is sufficiently gradual to allow a feedback mechanism to maintain the drum speed relatively constant despite the reduced drag resulting from blade 266 being disengaged from belt 210. The feedback mechanism could be based on a monitoring of current consumed by motor 202, which drives drum 205.

Optionally, follower wheel 264 may be spring mounted to provide for an even more gradual change in drag by spring biasing blade 266 away from belt 210 when follower wheel 264 engages ramp 235.

Figure 7:
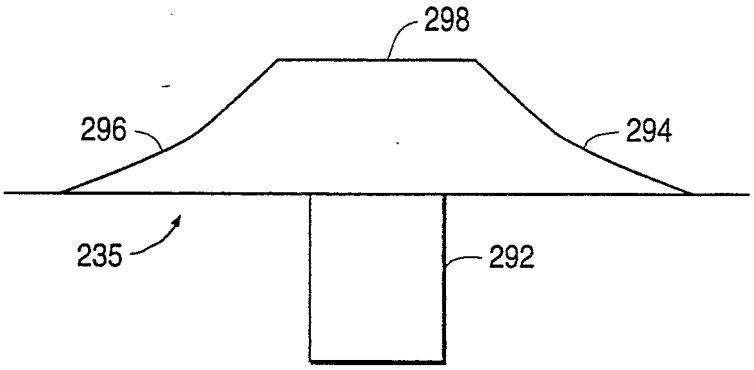
FIG. 7 is an end view of a component shown in FIG. 6 in more detail.

FIG. 7 shows a magnified View of ramp 235, including gradually sloping sides 294 and 296 for engaging follower wheel 264. The slope of slides 296 and 294 gradually increases in a direction towards plateau 298. Plateau 298 has an arc shape corresponding to the radius of drum 205. Because of this arc shape, housing 267 will maintain a constant distance from drum 205 when follower wheel 264 is on plateau 298. Ramp 235 also includes a stem 292 for plugging into drum 205.

Figure 8:
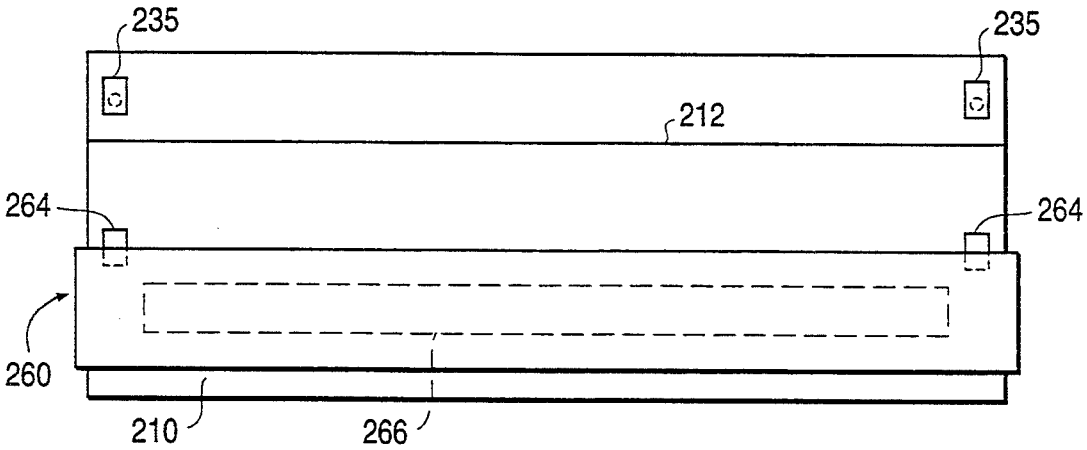
FIG. 8 is a longitudinal side view of the components shown in FIG. 6.

As shown in FIG. 8, drum 205 defines a hole at each end for receiving ramps 235. Belt 210 also defines a hole at each end for receiving ramps 235. The holes in belt 210 ensure that a discontinuity, such as a welding seam, on belt 210 will be correctly positioned relative to ramps 235 when belt 210 is installed on drum 205.

Ramp 235 is effectively a cam for imparting a motion to cleaning station 260 through drum 205. Because motor 202 drives drum 205, follower wheel 264 effectively mechanically engages with motor 202 to move cleaning station 260 away from drum 205.

The invention need not be practiced by moving the cleaning station using the motion of drum 202, however, and the cleaning station might mechanically engage with the motor 202 through a cam, or other structure, that does not directly contact drum 205. Further, it is not necessary to employ the motor 202 to move cleaning station 260 away from drum 205, since instead a separate electromechanical device could move the cleaning station away from drum 205.

Although ramp 235 is shown with sufficient height to move blade 266 away from belt 210, the invention may be practiced with a ramp having a height merely Sufficient to causes the cleaning blade to apply a reduced pressure to reduce the blade/seam interaction, without causing the cleaning blade to disengage from the belt.

Although a belt-drum combination functioning as a multi-layer substrate for the printing process has been illustrated, the cleaning systems of the prefer fed embodiments of the present invention may be employed with only a belt functioning as the substrate or only a drum functioning as the substrate.

Although the dimensions of the belt and the location of the stations around the belt may allow for the seam to be positioned where motion quality disturbances would not occur, for certain paper sizes, even if the cleaning blade were to scrape across the seam, copier 100 is advantageous because it avoids motion quality disturbances while accommodating various paper sizes.

Further, the preferred embodiments of the present invention conserve the useful life of the elements of the printer by avoiding mechanical stress caused by interaction between the cleaning system and the seam.

Additional advantages and modifications will readily occur to those skilled in the art. The invention in its broader aspects is therefore not limited to the specific details, representative apparatus, and illustrative examples shown and described. Various modifications and variations can be made to the present invention without departing from the scope or spirit of the invention, and it is intended that the present invention cover the modifications and variations provided they come within the scope of the appended claims and their equivalents.

We claim:

1. An apparatus comprising:

a substrate having a substantially uniform surface portion, and a nonuniform surface portion;

a particle remover for removing particles from the substrate;

means for moving the substrate relative to the particle remover; and means for moving the particle remover away from the substrate when the nonuniform surface portion of the substrate passes the particle remover.

2. The apparatus of claim 1 wherein the means for moving the particle remover includes means for mechanically engaging with the means for moving the substrate.

3. The apparatus of claim 1 wherein the means for moving the particle remover includes means for imparting a motion to the particle remover through the substrate.

4. The apparatus of claim 3 wherein the imparting means includes a cam on the substrate.

5. A method of operating an apparatus including a substrate having a substantially uniform surface portion, and a nonuniform surface portion, and a particle remover for removing particles from the substrate, the method comprising the steps of moving the substrate relative to the particle remover; and moving the particle remover away from the substrate when the nonuniform surface portion of the substrate passes the particle remover.

6. The method of claim 5 wherein the step of moving the particle remover includes the substep of mechanically engaging with the means for moving the substrate.

7. The method of claim 5 wherein the step of moving the particle remover includes the substep of imparting a motion to the particle remover through the substrate.

8. An apparatus comprising:

a moveable substrate;

a cam on the substrate; and a particle remover for removing particles from the substrate, the particle remover being engageable with the cam to move away from the substrate.

9. The apparatus of claim 8 wherein the particle remover comprises a blade.

10. The apparatus of claim 8 wherein the particle remover comprises:

a blade; and a rolling member, coupled to the blade, for engaging the cam.

11. The apparatus of claim 8 wherein the particle remover comprises:

a blade; and a wheel, coupled to the blade, for engaging the cam.

12. An assembly for a printing apparatus, the assembly comprising:

a moveable substrate having a seam;

cleaning means engageable with the substrate; and means for disengaging the cleaning means from the substrate when the seam passes between the substrate and the cleaning means.

13. The assembly of claim 12 wherein the disengaging means includes a cam on the substrate for pushing the cleaning means away from the substrate.

14. An apparatus comprising:

a substrate having a substantially uniform surface portion, and a nonuniform surface portion;

a subassembly;

a particle remover, coupled to the subassembly, for removing particles from the substrate;

means for moving the substrate relative to the subassembly; and means for moving the subassembly away from the substrate when the nonuniform surface portion of the substrate passes the particle remover.

15. The apparatus of claim 14 wherein the means for moving the subassembly includes means for mechanically engaging with the means for moving the substrate.

16. The apparatus of claim 14 wherein the means for moving the subassembly includes means for imparting a motion to the subassembly through the substrate.

17. The apparatus of claim 16 wherein the imparting means includes a cam on the substrate.

18. A method of operating an apparatus including a substrate having a substantially uniform surface portion, and a nonuniform surface portion, a subassembly, and a particle remover, coupled to the subassembly, for removing particles from the substrate, the method comprising the steps of moving the substrate relative to the subassembly; and moving the subassembly away from the substrate when the nonuniform surface portion of the substrate passes the subassembly.

19. The method of claim 18 wherein the step of moving the subassembly includes the substep of mechanically engaging with the means for moving the substrate.

20. The method of claim 18 wherein the step of moving the subassembly includes the substep of imparting a motion to the subassembly through the substrate.

21. An apparatus comprising:

a moveable substrate;

a cam on the substrate;

a subassembly engageable with the cam to move away from the substrate; and a particle remover, coupled to the subassembly, for removing particles from the substrate.

22. The apparatus of claim 21 wherein the particle remover comprises a blade.

23. The apparatus of claim 21 wherein the particle remover comprises a blade, and the subassembly comprises a rolling member for engaging the cam.

24. The apparatus of claim 21 wherein the particle remover comprises a blade, and the subassembly comprises a wheel for engaging the cam.

25. An apparatus comprising:

a substrate having a substantially uniform surface portion, and a nonuniform surface portion;

a particle remover for removing particles from the substrate, by applying a pressure to the substrate;

means for moving the substrate relative to the particle remover; and means for causing the particle remover to reduce the pressure when the nonuniform surface portion of the substrate passes the particle remover.

26. The apparatus of claim 25 wherein the causing means includes means for mechanically engaging with the means for moving the substrate.

27. The apparatus of claim 24 wherein the causing means includes means for imparting a motion to the particle remover through the substrate.

28. The apparatus of claim 24 wherein the imparting means includes a cam on the substrate.

29. A method of operating an apparatus including a substrate having a substantially uniform surface portion, and a nonuniform surface portion, and a particle remover for removing particles from the substrate by applying a pressure to the substrate, the method comprising the steps of:

moving the substrate relative to the particle remover; and causing the particle remover to reduce the pressure when the nonuniform surface portion of the substrate passes the particle remover.

30. The method of claim 29 wherein the causing step includes the substep of mechanically engaging with the means for moving the substrate.

31. The method of claim 29 wherein the causing step includes the substep of imparting a motion to the particle remover through the substrate.

32. An assembly for a printing apparatus, the assembly comprising:

a moveable substrate having a seam;

means for applying a pressure to the substrate; and means for causing the applying means to reduce the pressure when the seam passes between the substrate and the applying means.

* * * * *